United States Patent [19]

Steine

[11] Patent Number: 4,806,394

[45] Date of Patent: Feb. 21, 1989

[54] METHOD FOR PRODUCING A WEAR-RESISTANT, TITANIUM-CARBIDE CONTAINING LAYER ON A METAL BASE

[75] Inventor: Hans-Theo Steine, Chavannes, Switzerland

[73] Assignee: Castolin S.A., Saint-Sulpice, Switzerland

[21] Appl. No.: 112,832

[22] PCT Filed: Feb. 4, 1987

[86] PCT No.: PCT/CH87/00016

§ 371 Date: Sep. 30, 1987

§ 102(e) Date: Sep. 30, 1987

[87] PCT Pub. No.: WO87/04732

PCT Pub. Date: Aug. 13, 1987

[30] Foreign Application Priority Data

Feb. 4, 1986 [CH] Switzerland ..... 425/86

[51] Int. Cl.[4] ..... B05D 1/10

[52] U.S. Cl. ..... 427/423; 427/376.3; 428/937; 428/627

[58] Field of Search ..... 427/423, 376.3; 428/939

[56] References Cited

U.S. PATENT DOCUMENTS

| | | | |
|---|---|---|---|
| 3,617,358 | 11/1971 | Dittrich | 427/423 |
| 3,779,720 | 12/1973 | Ellis et al. | 427/34 |
| 3,896,244 | 7/1975 | Ellis et al. | 427/423 X |
| 3,941,903 | 3/1976 | Tucker | 427/190 |
| 4,395,279 | 7/1983 | Houck | 427/423 X |

FOREIGN PATENT DOCUMENTS

| | | | |
|---|---|---|---|
| 659644 | 3/1963 | Canada | 427/423 |
| 2050424 | 1/1981 | United Kingdom . | |
| 2076019 | 11/1981 | United Kingdom . | |

*Primary Examiner*—Shrive Beck

*Attorney, Agent, or Firm*—Hopgood, Calimafde, Kalil, Blaustein & Judlowe

[57] ABSTRACT

A method is provided for producing a wear-resistant layer on a metal base. A material, containing about 10 to 50% by weight of TiC in the form of sintered or agglomerated particles in which TiC is dispersed in a matrix alloy selected from the group consisting of iron, nickel and cobalt alloys, is applied to a metal base by thermal spraying. The sprayed-on layer is subjected to heat treatment to provide precipitation hardening by virtue of the precipitation of TiC as uniformly dispersed fine grains. The sintered or agglomerated particles containing TiC have a grain size of $-150$ to $+37$ $\mu$m. The layer is applied by autogeneous flame spraying to a thickness of at least about 1 mm.

10 Claims, No Drawings

METHOD FOR PRODUCING A WEAR-RESISTANT, TITANIUM-CARBIDE CONTAINING LAYER ON A METAL BASE

The present invention relates to a method for producing a wear-resistant layer in accordance with the pre-characterizing clause of claim 1.

The German patent specification No. DE 2208070 describes a method of this kind, according to which a metal base is provided with a thin, wear-resistant layer of a thickness of at most about 0.635 mm, the spraying being effected by plasma flame-spraying and the material used having a grain size in the order of magnitude of −44/+88 μm, for example.

In this known method it is important that the layer is drastically chilled during the spraying-on thanks to the cooling action of the base body, thus creating a microstructure consisting of titanium-carbide grains which are dispersed in a base matter, the base matter being formed of an austenite conversion product containing martensite. This leads already without further heat treatment to a relatively hard layer in which, due to the plasma spraying process, rounded titanium-carbide grains are present.

However, the layers which can be produced in this way are very limited in their thickness, preferably thicknesses from 0.381 mm to 0.254 mm and of 0.127 mm are stated, since the mentioned structure would otherwise lead to very high internal stress.

The small thickness corresponds to an equally limited life. Besides, the possibilities of mechanical machining are very narrowly limited and the elasticity of the layer is extremely low due to the small grain size of the spraying material and the corresponding structure built up of smallest lamellae.

Wear resistant layers which were produced by flame-spraying without fusing and which have a high hardness thanks to the incorporation of hard materials ("Hartstoffe") such as carbides, silicides, borides, etc. or which consist of hard alloys, appear to be highly sensitive in respect to the formation of cracks due to the occurrence of internal stress in the layer. The thickness of the layer which can be obtained is therefore very limited.

On the other hand, the use of self-fluxing alloys which attain a high hardness after fusing, leads during the fusing process to excessively high temperatures for many applications, which temperatures have very detrimental effects on the base material with respect to distortion, embrittlement and other influences.

The object of the invention is to provrde a method for producing wear resistant layers of great hardness, by which layers of substantially longer life than that of the known layers can be produced and which, furthermore, allows mechanical machining after the spraying operation and is relatively free of problems with respect to internal stress in the layer.

This is attained, according to the invention, by the features of the method as set forth in the appended claims. Claims 2 to 10 describe particular embodiments of the method according to the invention.

It has been found, surprisingly, that when titanium carbide in a metallic matrix is applied by oxy-acetylene flame-spraying without subsequent fusing, a layer is first obtained which has a free-machining property and which is capable of hardening by a subsequent heat treatment at relatively low temperature, thus providing a hardness of 500 to 700 Hv in the final state.

In contrast with the mentioned method which is carried out by plasma flame-spraying, in the present method the material of the layer is molten practically homogenously in the oxy-acetylene flame during the spraying process, with the titanium carbide being dissolved in the matrix alloy. The thus obtained layer of austenitic nature is free-machinable. In the following heat treatment the titanium carbide is then precipitated in very fine grains and uniform distribution.

The layer has a lamellar structure with relatively big lamellae, in accordance with the particle size, so that a greater elasticity of the layer is obtained. Furthermore it is to be noted that the coefficient of expansion of the layer is very near the coefficient of expansion of the matrix alloy.

As a consequence, with the present method there appears practically no internal stress and accordingly a thickness of the layer of more than 3 mm can be reached, while the heat-treatment can be effected without difficulties. The following examples illustrate the results of the method of the invention.

EXAMPLE 1

A shaft of 50 mm diameter, which has to withstand very strong wear, was first coated in the following manner.

After preparing by sanding with emery, the shaft was pre-heated to 150° C. and subsequently a bonding layer of 0.1 mm thickness was applied there to. This was done by spraying by an autogenous flame-spray apparatus in a usual way with a powder having a composition, in percent by weight, of 95.0 Ni, 5.0 Al.

Upon the bonding layer a wear-resistant layer of 1.8 mm thickness was applied, also by autogenous flame spraying with the usual parameters, without subsequent fusing, while the composition of the spraying powder, in percent by weight, and the grain size was as follows: 33.0 Ti C with a matrix alloy of 0.9 C, 1.0 Cr, 0.3 Cu, 0.5 Mo, 1.9 Mn, 1.0 Si, 0.2 V , remainder Fe. Grain size −150/+37 μm.

The coated shaft was machined and brought to the final dimensions.

Thereupon, it was kept in a muffle furnace at 550° C. during five hours. The hardness of the coated layer had a value of 420 Hv after the machining, after the heat-reatment a hardness of 640 Hv was measured.

EXAMPLE 2

The sliding surface of 100×100 mm of a sliding plate of 50 mm thickness was coated in the following way.

After preparing the sliding surface by sanding with emery, the plate was pre-heated to 100° C. and subsequently a bonding layer of 0.1 mm thickness was applied thereon.

This has done by applying a usual commercial powder for bonding layers (Castolin 51000) by autogenous flame-spraying. Thereupon, a wear resistant layer of 1.2 mm thickness was applied, again by autogenous flame spraying without subsequent fusing, whereby the composition of the spraying powder (grain size −150/+37 μm) was the following:

32% TiC in a matrix alloy of 0.2 C, 0.5 Cr, 0.5 Cu, 6.0 Mo, 15.0 Ni, 0.7 Al, 9.0 Co, 0.7 Ti, 0.1 Nb, remainder Fe. The coated surface was machined.

Thereafter, the sliding plate was treated in a furnace under protective atmosphere at 450° C. during four hours. The hardness of the sliding surface was 450 Hv before the heat-treatment, after the heat treatment the measured hardness was 650 Hv.

EXAMPLE 3

A shaft of 40.0 mm diameter was treated in the following way to achieve a high wear resistance.

After preparing the surface by sanding with emery, the shaft was provided with a wear-resistant layer of 1.5 mm thickness by autogenous flame-spraying under the usual working conditions, whereby the composition of the spraying material, in percent by weight, was chosen as follows: 33.0 TiC, in a matrix alloy of 0.35 C, 2.0 Cr, 1.0 Cu, 2.0 Mo, remainder Fe. The grain size was in the range $-150/+37$ μm.

The surface was thereafter machined and finished by polishing to the desired dimension, whereby the surface layer kept a thickness of 1 mm.

After the machining the finished part was maintained at 500° C. in a muffle furnace during five hours. The hardness of the layer before the heat-treatment was 400 Hv, after the heat-treatment a hardness of 680 Hv was measured.

EXAMPLE 4

A wearing part having the dimensions 200×60×30 mm was coated on one of the surfaces of 200×60 mm in the following way.

The surface to be coated was prepared by sanding with emery, upon this surface a powdered spraying material of the grain size $-150/+37$ μm containing, in percent by weight, 16.5 TiC in a matrix alloy of 0.5 C, 14.0 Cr, 0.5 Cu, 14.0 Mo, 3.5 W, remainder Ni, was applied by autogenous flame-spraying without subsequent fusing under usual conditions. The wear-resistant layer had a thickness of 2.2 mm and was thereafter machined to reach a thickness of the layer of 2.0 mm. Thereupon, the wearing part was maintained in a muffle furnace at 450° C. during five hours. The hardness was 380 Hv before the heat-treatment and raised to 550 Hv after the heat-treatment.

EXAMPLE 5

The process of Example 4 was analogously repeated with a spraying material having the composition, in percent by weight, of 20.0 Ti C in a matrix alloy of 0.5 C, 14.0 Cr, 0.5 Cu, 14.0 Mo, 5.0 W, remainder Co. The hardness of the heat-treated part reached the value of 530 Hv.

As is clearly apparent, a method is provided for producing a wear-resistant layer on a metal base from alloy particles of TiC. A material containing about 10 to 50 percent by weight of sintered or agglomerated particles TiC in a matrix alloy of iron and/or nickel alloy or a cobalt alloy is applied by thermal spraying. The sprayed-on layer is then subjected to a heat-treatment in the temperature range of about 400°–650° C. The particles of spray material are characterized by a grain size of about $-150/+37$ μm. The wear-resistant layer is applied by autogenous flame spraying to a thickness of at least about 1 mm.

In one embodiment, the matrix alloy is an iron and/or nickel alloy which contains at least two additional alloy elements among the following in the indicated ranges of percentage by weight of: 0–1 C, 0–25 Cr, 0–20 Mo, 0–15 Cu, 0–0.5 V, 0–2 Al 0–1.5 Nb, 0–1 V, 0–2 Ti, 0–4 W, 0–2 Si.

In a specific embodiment, the spray particles contain about 30 to 35 percent by weight TiC and the matrix alloy is an iron alloy containing additional alloy elements as follows by weight percent: 0.1–0.8 C, 2–22 Cr, 0.1–4 Mo, 0.5–2 Cu, 0–0.5 V, 0–1 Al, 0–1 Ni, 0–1 Ti, 0–2 Mn, 0–1.5 Si.

A further embodiment includes spray particles containing about 20 to 35 percent by weight TiC, the matrix alloy being an iron alloy containing additional alloy elements as follows in percentage by weight: 0–0.8 C, 0–20 Cr, 2–15 Mo, 0.5–1 Cu, 0–1.5 Al, 5–16 Ni, 0–16 Co, 0–1 Ti, 0–1 Nb.

Another example of the method comprises the use of spray particles which contain 15 to 33 percent by weight TiC in a matrix alloy of nickel containing additional alloy elements as follows in percent by weight:

14–25 Cr, 2–16 Mo, 0–1 Cu, 0–1 Al, 0–2.5 Ti, 0–1 Nb, 0–0.5 C, 0–3.5 W.

A further method is one using a matrix alloy cobalt with about 10 to 50 percent by weight TiC, the alloy also containing elements as follows in percent by weight: 0–1 C, 0–25 Cr, 0–20 Mo, 0–2 Mn, 0–2 Cu, 0–2 Al, 0–1.5 Nb, 0–1 V, 0–2 Ti, 0–5 W, 0–2 Si.

Another embodiment of the method is one in which the spray particles contain about 15 to 33 percent by weight TiC, the matrix alloy being a cobalt alloy containing the following elements in percent by weight: 14–25 Cr, 2–16 Mo, 0–1 Cu, 0–4 Al, 0–2.5 Ti, 0–1 Nb, 0–1 C, 0–5 W.

The matrix alloys may contain in addition less than about 3, preferably less than about 1 percent by weight of $ZrO_2$.

As stated above, while the heat treatment temperature may range from about 400° C. to 650° C., a preferred temperature range is about 400–600° C. over a period of about 1–10 hours, a more preferred range being about 450–550° C. over a period of about 1–5 hours.

I claim:

1. A method for producing a wear-resistant layer on a metal base which comprises:

providing particulate material comprised of a matrix metal selected from the group consisting of iron, nickel and cobalt alloys, said matrix metal having contained therein about 10 to 50 percent by weight of TiC, said particulate material having a grain size rangrng from about $-150$ to 37 μm, applying a layer of said material on a metal base by autogenous flame spraying to provide a bonded layer of at least about 1 mm thickness, and then subjecting said sprayed-on layer to heat treatment at a temperature of about 400° C. to 650° C. to harden said layer by the precipitation of TiC from said matrix metal in the form of uniformly distributed fine grains.

2. The method according to claim 1, wherein matrix metal is an iron and/or nickel alloy containing at least two additional alloy elements as follows in percent by weight: 0–1 C, 0–25 Cr, 0–20 Mo, 0–15 Co, 0–2 Cu, 0–0.5 V, 0–2 Al, 0–1.5 Nb, 0–1 V, 0–2 Ti, 0–4 W, 0–2 Si.

3. The method according to claim 2, wherein the particles contain about 30–35 percent by weight TiC and that the matrix metal is an iron alloy containing additional alloy elements as follows in percent by weight: 0.1–0.8 C, 2–22 Cr, 0.1–4 Mo, 0.5–2 Cu, 0–0.5 V, 0–1 Al, 0–1 Ni, 0–1 Ti, 0–2 Mn, 0–1.5 Si.

4. A method according to claim 2, wherein the particles contain about 20–35 percent by weight TiC and that the matrix metal is an iron alloy containing the following elements in percent by weight: 0–0.8 C, 0–20 Cr, 2–15 Mo, 0.5–1 Cu, 0–1.5 Al, 5–16 Ni, 0–16 Co, 0–1 Ti, 0–1 Nb.

5. A method according to claim 2, wherein the particles contain about 15–33 percent by weight TiC and the matrix metal is a nickel alloy containing additional alloy elements as follows in percent by weight: 14–25 Cr, 2–16 Mo, 0–1 Cu, 0–1 Al, 0–2.5 Ti, 0–1 Nb, 0–0.5 C, 0–3.5 W.

6. The method according to claim 1, wherein the metal is a cobalt alloy which contains at least two additional alloy elements as follows in percent by weight: 0–1 C, 0–25 Cr, 0–20 Mo, 0–2 Mn 0–2 Cu, 0–2 Al, 0–1.5 Nb, 0–1 V, 0–2 Ti, 0–5 W, 0–2 Si.

7. The method according to claim 6, wherein the particles contain about 15–33 percent by weight TiC and wherein the cobalt alloy contains additional alloy elements as follows in percent by weight: 14–25 Cr, 2–16 Mo, 0–1 Cu, 0–1 Al, 0–2.5 Ti, 0–1 Nb, 0–1 C, 0–5 W.

8. The method according to claim 1, wherein the matrix alloy contains an addition of less than about 3 percent by weight of $ZrO_2$.

9. The method according to claim 1, wherein the heat treatment is conducted in the temperature range of 400°–600° C. over a period of about 1–10 hours.

10. The method according to claim 9, wherein the heat treatment is conducted in the temperature range of about 450°–550° C. over a period of about 1–5 hours.

* * * * *